United States Patent [19]

Bellehumeur et al.

[11] Patent Number: 4,747,720

[45] Date of Patent: May 31, 1988

[54] SPONGE APPLICATOR AND VALVE

[76] Inventors: Dennis W. Bellehumeur, 2765 Bouffard Rd., Windsor, Ontario, Canada, N9H-1W3; Garry E. Schultz, 16205 Stricker East, Detroit, Mich. 48021

[21] Appl. No.: 775,765

[22] Filed: Sep. 13, 1985

Related U.S. Application Data

[63] Continuation-in-part of Ser. No. 544,628, Oct. 24, 1983.

[30] Foreign Application Priority Data

Oct. 27, 1982 [CA] Canada ..... 414298

[51] Int. Cl.[4] ..... A45D 34/00; B05C 17/00; A47L 13/16

[52] U.S. Cl. ..... 401/205; 401/6; 401/186; 401/196; 401/207; 401/277

[58] Field of Search ..... 401/183, 196, 207, 205, 401/203, 6, 186, 277

[56] References Cited

U.S. PATENT DOCUMENTS

| | | | |
|---|---|---|---|
| 673,918 | 5/1901 | Murray | 401/205 |
| 1,030,137 | 6/1912 | Smith . | |
| 1,509,219 | 9/1924 | Alexander | 401/205 |
| 2,048,689 | 7/1936 | Feasel | 401/205 |
| 2,817,106 | 12/1957 | Putz | 401/183 |
| 2,860,359 | 11/1958 | James | 401/183 |
| 2,888,695 | 6/1959 | Anderson et al. . | |
| 2,895,486 | 7/1959 | Sayer | 401/207 X |
| 2,973,538 | 3/1961 | Thomson . | |
| 2,976,560 | 3/1961 | Turner | 401/205 X |
| 3,072,953 | 1/1963 | Bunke . | |
| 3,106,742 | 10/1963 | Schultz et al. | 401/205 X |
| 3,261,515 | 7/1966 | Luedtke | 401/205 X |
| 3,490,657 | 1/1970 | Williams et al. | 401/196 X |
| 3,814,525 | 6/1974 | Spencer | 401/207 X |
| 3,951,157 | 4/1976 | Idec . | |
| 4,013,369 | 3/1977 | Turek . | |
| 4,078,865 | 3/1978 | Moser | 401/207 X |
| 4,135,274 | 1/1979 | Freeman . | |
| 4,150,904 | 4/1979 | Stewart | 401/205 X |
| 4,165,942 | 8/1979 | Johansson | 401/203 X |
| 4,225,253 | 9/1980 | Fraleigh . | |
| 4,276,718 | 7/1981 | Keeton et al. . | |
| 4,329,990 | 5/1982 | Sneider | 401/196 X |
| 4,341,231 | 7/1982 | Costa . | |

FOREIGN PATENT DOCUMENTS

| | | | |
|---|---|---|---|
| 143760 | 10/1912 | Canada . | |
| 164430 | 8/1915 | Canada . | |
| 550505 | 12/1957 | Canada | 401/207 |
| 1017103 | 9/1977 | Canada . | |
| 1077440 | 5/1980 | Canada . | |
| 1461651 | 12/1966 | France | 401/205 |
| 21182 | of 1890 | United Kingdom | 401/207 |

*Primary Examiner*—Steven A. Bratlie
*Attorney, Agent, or Firm*—Cushman, Darby & Cushman

[57] ABSTRACT

A liquid applicator includes a combined liquid container and handle with an axially extending, liquid permeable sleeve. An elongated tube having apertures throughout its length provides internal support for the sleeve and valve means provides controlled flow of the liquid from the container, through the tube and to the permeable sleeve. In another embodiment the applicator consists of an elongated arm having an applicator head at one end, the other end having a threaded or snap connection for attachment to a squeeze type container. A plastic tube extends from the head to the container attachment and is enclosed by the arm.

8 Claims, 5 Drawing Sheets

SPONGE APPLICATOR AND VALVE

RELATED APPLICATION

This application is a Continuation-In-Part of application Ser. No. 544,628 filed Oct. 24, 1983 now abandoned.

FIELD OF THE INVENTION

This invention relates to liquid applicators and specifically to an applicator having a liquid permeable portion adapted for connection to a liquid storage means.

BACKGROUND OF THE INVENTION

Applicators for applying liquid to the human body, for example tanning lotions and the like, are well known and in most instances, they include a storage section enclosing liquid which can be placed in contact with an applicator head or the like, normally attached to or integral with the storage means. One example of the prior art is Canadian Pat. No. 164,430 of Oct. 29, 1912 which discloses a moistening apparatus comprising a reservoir with a porous body and a sponge in a cap in contact with the porous body. The sponge head can be removed for refilling the container.

Another example is Canadian Pat. No. 1,017,103 of Sept. 13, 1977 which discloses a pre-filled applicator or scrubber having an elongated storage section or container with an absorbent head such as a sponge attached to one end thereof. A series of apertures in the end of the storage tube serve to act as passageways for the liquid into the sponge head.

A further example of the prior art is U.S. Pat. No. 3,490,657, Williams et al, of January 1970. The apparatus in this patent uses a rechargeable aerosol cartridge to force liquid through a tube and out towards a mop.

A still further example is shown in Canadian Pat. No. 550,505 of December, 1957, in which a tube connects a sponge head to a replaceable container 18.

One of the problems with conventional devices such as those disclosed above is that the applicator portion of the device is very small. Another problem is that if the applicator section or sponge is of substantial size there is nothing to support it when the lotion is being applied to the body.

Another disadvantage of prior art examples such as that shown in the Williams patent, is that there is no liquid storage container or replaceable tube.

In the example of Canadian Pat. No. 550,505 the interconnecting tube 10 can become clogged or corroded and the whole unit must be disposed of.

According to the examples of the present invention, one embodiment provides a liquid permeable head attached to a replaceable, liquid transmitting tube which, if it becomes clogged or corroded during use, can easily be replaced.

SUMMARY OF THE INVENTION

The deficiencies of the conventional devices mentioned above have been overcome in the present invention which provides a hand-held applicator to facilitate the smooth application of tanning oils or lotions by an individual to various parts of the body. In one embodiment an elongated, preferably plastic tube contains the liquid substance and an axially extending, liquid permeable sleeve such as a sponge is detachably secured to one end of the container, means being provided therebetween for the free flow of liquid from the container into the interior of the permeable sleeve where it seeps through to the surface thereof for application to the body. An elongated hollow tube is also connected to the end of the container and extends outwardly therefrom and is coaxially located centrally of the permeable sleeve to give support to the sleeve when the applicator is in use. A valve positioned between the storage container and the support tube provides means for controlling the flow of fluid from the container to the sponge.

The applicator assists in the independent application of oils or lotions by an individual and, due to its design, it allows an individual to easily reach difficult areas of the body such as the upper and lower back to apply lotions thereto.

The container also serves as a handle for the applicator and the surface thereof can be provided with a slip-resistant surface such as ribs or dimples. The container handle can be rigid or semi-soft so that pressure applied to its surface can result in an increase in the flow of liquid into the applicator sleeve, subject to the positioning of the valve.

In another embodiment, the applicator consists of an elongated arm having a liquid permeable head at one end, the other end being threadably or similarly connected to the top of a squeeze type bottle of lotion. A tube extends throughout the length of the arm from the head to the bottle connection and serves to conduct fluid from the bottle to the applicator head when pressure is applied to the bottle.

In one preferred form, the container handle and applicator sleeve is of elongated, cylindrical configuration but other suitable configurations may also be used such as a triangular or rectangular cross-section which may facilitate easier handling and which may also provide an increased application area.

According to one broad aspect, the invention relates to apparatus for applying liquid to a person's body and having a storage container for the liquid, sponge means associated with the container for receiving liquid therefrom and means effecting and controlling flow of the liquid from the container to said sponge. The apparatus comprises an elongated, combined fluid transmission and sponge support tube connected to and extending axially outwardly from one end of the container. The tube has a plurality of apertures in the sidewall thereof to provide passage of liquid from the container into the sponge means which comprises a liquid permeable sleeve coaxially located over the support tube and enclosing the full length thereof. Valve means are provided intermediate the liquid storage means and the support tube and operable to control the flow of liquid from the container to the sponge means.

According to another broad aspect, the invention relates to apparatus for applying liquid to a person's body, comprising a storage container for the liquid, sponge means interconnected with the container for receiving liquid therefrom and means for transmitting the liquid from the container to the sponge means comprising an elongated arm of open, U-shaped cross-section having means at one end for connection to the liquid storage container and a liquid permeable head at the other end and extending transverse to the arm on both sides thereof, the sponge means being mounted on the head. A conduit extends the length of the arm from the storage container to the head and is located within the confines of the U-shaped arm. Means in the arm detachably secure the conduit therein.

BRIEF DESCRIPTION OF THE DRAWINGS

The invention is illustrated by way of example in the accompanying drawings in which.

DESCRIPTION OF THE PREFERRED EMBODIMENT

Figure 1:
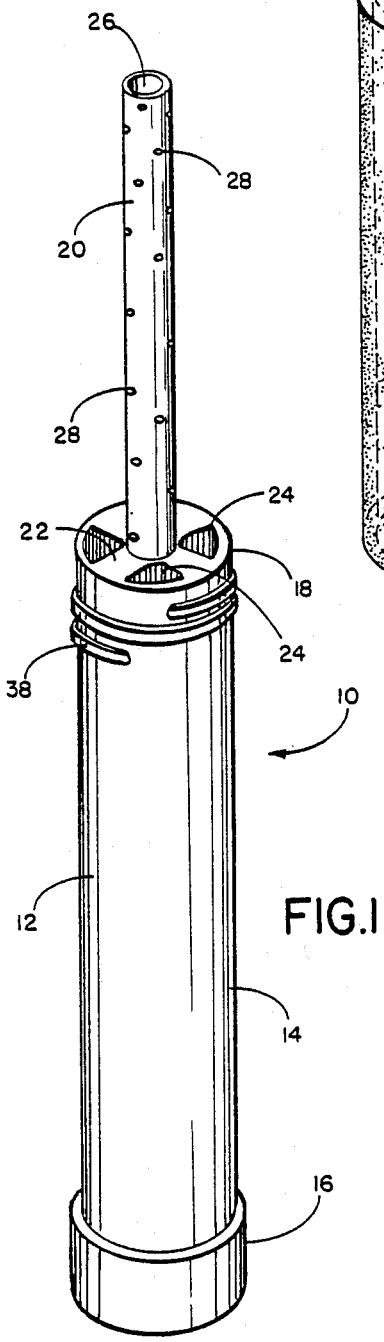
FIG. 1 is a perspective view of one embodiment of the applicator container and its associated support tube.
Figure 2:
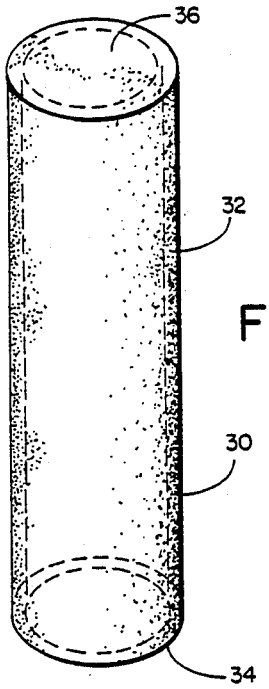
FIG. 2 is a perspective view of the permeable sleeve.
Figure 3:
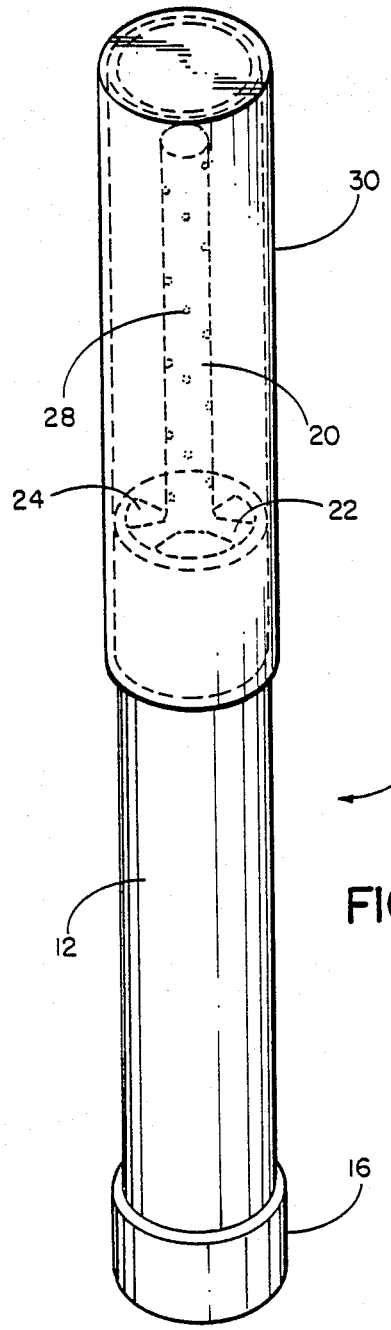
FIG. 3 is a perspective view of the applicator in assembled form.

Referring to FIGS. 1-3, the applicator generally indicated at 10 includes a container 12 of elongated, cylindrical configuration having a dimpled or ribbed surface 14 to facilitate grasping of the container by a user. The container 12 also serves as a handle for the applicator during its use. One end of the container has a detachable cap 16 to allow filling of the container body with lotion or the like. The other end 18 of the container is open and an elongated support tube 20 is either detachably secured to or is integrally formed with the container 12 and, as illustrated, is connected to the open end 18 of the container and extends axially outwardly from the container end. A plurality of circumferentially spaced ribs 22 serve to interconnect the tube to the container end, the tube being of a smaller diameter than that of the container body. The spaces between the ribs 22 provide apertures 24 for the flow of fluid from the container 12 outwardly of the ends 18. The support tube 20 has a hollow tubular center 26, the interior thereof being connected to the exterior surface by a plurality of surface apertures 28.

FIG. 2 illustrates the elongated, liquid permeable sleeve 30, preferably a sponge-like material, the sleeve having a substantial thickness as indicated at 32 so as to retain a preferred amount of lotion or liquid supplied to it from the container 12. The lower end 34 of the sleeve is open and the upper end 36 is closed. The inner diameter of the sleeve 30 is such as to provide a frictional but liquid tight fit between the lower end of the sleeve 34 and gripping ribs 38 adjacent the end 18 of the container 12. Such a connection can of course be replaced by a more sophisticated form of connection such as a screw-on collar or the like.

It will be seen from FIG. 3 that, in the assembled condition, liquid may flow from the container through the apertures 24 and through the hollow centre 26 of the support tube 20 and out of the apertures 28 onto the interior surface of the sleeve 30 where it will seep through the permeable substance of the sleeve and can be applied to the body. While not shown, the apertures 24 in the end of the container 12 may have their respective area adjusted by means of a rotatable closure disc or the like.

Additionally, when not in use, the sleeve may be protected by an outer slip-on cover which can be snapped onto or threadably attached to one end of the container 12.

The container body 12 may be formed of a rigid material or can be of a semi-soft material so that squeezing of the container by the user can provide an increased flow of liquid into the area of the permeable sleeve.

Figure 4:
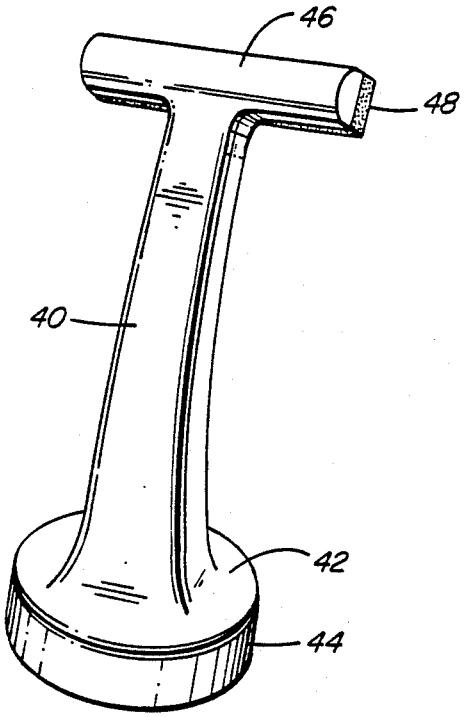
FIGS. 4 and 5 are perspective views of a second embodiment of the invention.
Figure 6:
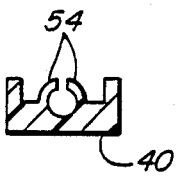
FIG. 6 is a cross-sectional view taken along the lines 6—6 of FIG. 5.
Figure 5:
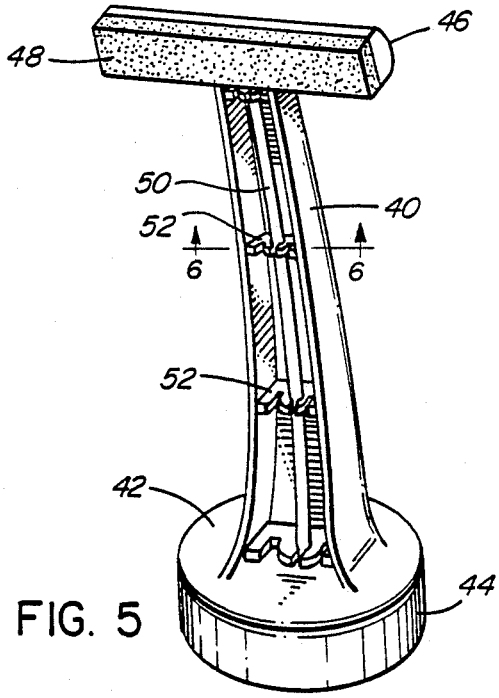

Referring now to the embodiment of FIGS. 4-6, the applicator includes an elognated, preferably curved arm 40 formed of molded rigid plastic or other suitable material. The base 42 of the arm consists of a cap 44 having a means of connection such as a threaded interior or a snap on arrangement so that the cap 44 can be detachably secured to the top of a squeezable form of container such as that shown in FIG. 1. The outer end of the arm has a transversely extending head 46 to which a sponge-like, liquid permeable face 48 is adhesively secured.

As shown in FIG. 5, a plastic tube 50 extends from the base 42 to the head 46, the function of the tube 50 being to conduct fluid from the squeezable bottle to the sponge face 48 when pressure is applied to the exterior of the bottle. As shown in FIGS. 5 and 6, the fluid conducting tube 50 is retained in the arm 40 by means of intermittently spaced brackets 52 each of which consists of a pair of resilient or semi-rigid clips 54 which serve to retain the tube position.

A further embodiment of the invention is shown in FIGS. 7-10 inclusive. Functionally, this embodiment is very similar to that shown in FIGS. 1-3, but, valve means is incorporated in the apparatus to control the flow of liquid from the storage container to the support tube and then to the sponge.

Figure 7:
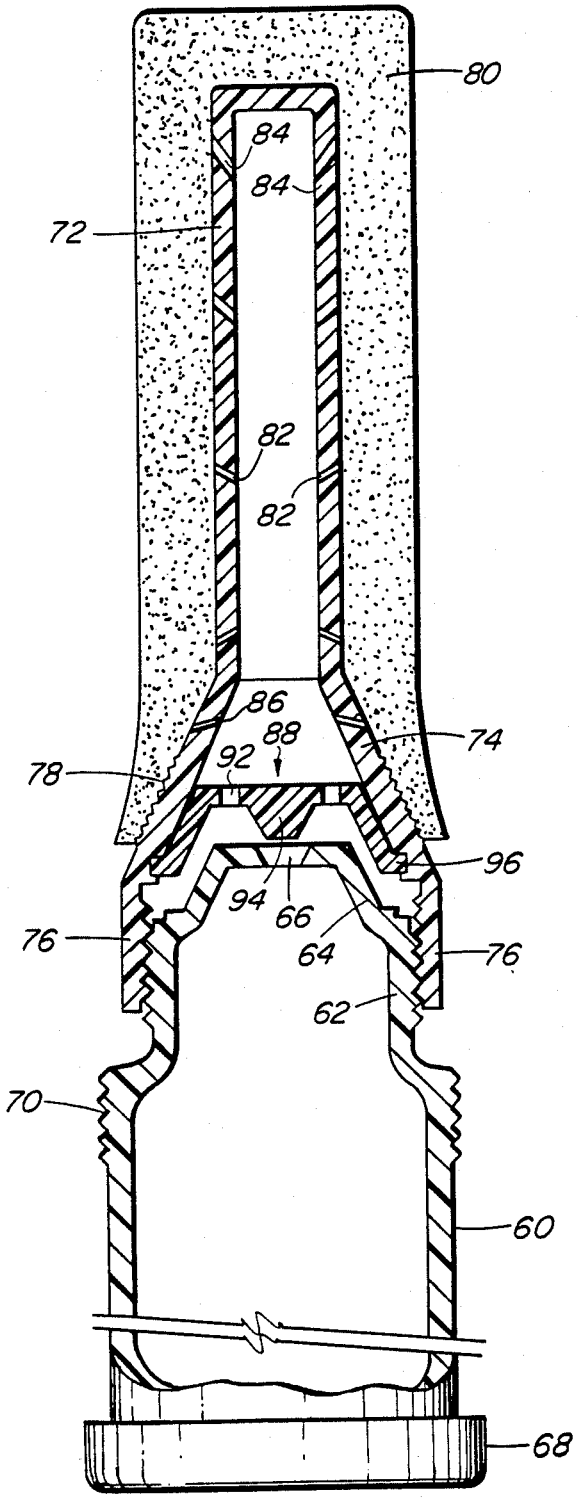
FIG. 7 is a cross-sectional view of another embodiment of the invention showing the valve means in an open position.

Looking first at FIG. 7, the container 60 is formed of a pliable material such as soft plastic and has a threaded neck portion 62 and a frustro-conical top portion 64 with a centrally located passageway 66 in the upper end. The container 60 may also include a suitable closure 68 in the bottom thereof to facilitate filling the container.

The outer surface of the container may include dimples or knurling 70 to provide a gripping surface to a user.

The sponge support tube 72 is an elongated, cylindrical member having a frustoconical lower portion 74 terminating in a cylindrical, interiorly threaded base portion 76 which threadably engages the threaded neck 62 on the container 60. The frustoconical portion 74 of the support tube may include a friction surface 78 to retain the lower end of a sleeve sponge 80 located on the support tube 72. The sponge sleeve can be of any suitable size, preferably an eighth to a ½ inch thick and such sponges can be obtained or manufactured in different pore sizes to meet various requirements for liquid retention and/or passage.

The support tube 72 is provided with a series of openings 82 and, while the apparatus will function adequately with a common size of an opening, it is preferred that these openings are graduated in diametric size with the openings 84 towards the outer end of the tube being larger in diameter than the openings 86 towards the inner end of the support tube. These openings can also be angularly disposed with respect to the longitudinal axis of the support tube in order to direct the liquid into specific areas of the sponge sleeve. By providing a series of graduated sized openings, it has been found that the liquid from the container is applied more evenly throughout the length of the sponge sleeve 80.

Figure 8:
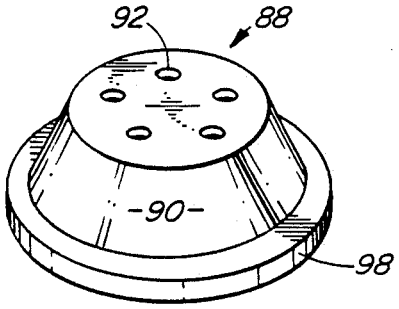
FIG. 8 is a perspective view of the valve means.
Figure 9:
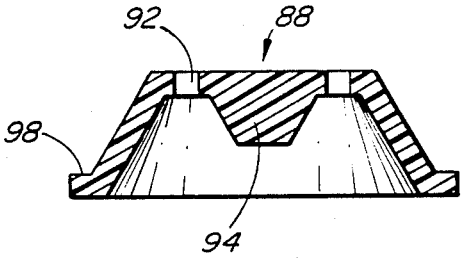
FIG. 9 is a cross-sectional view of the valve means.

It will be appreciated that suntan liquids, body oils or the like are available in varying viscosity. In order to provide a control of flow of the liquid from the container 60 through the support tube 72 to the sponge 80, a valve means indicated generally at 88 is located intermediate the top of the container and the lower end 74 of the support tube 72. As seen in FIGS. 8 and 9, the valve means 88 comprises a disc-like body with a frustro-conical wall 90 that matches the configuration of the frustro-conical walls 64 of the container and 74 of the support tube. The body of the valve 88 has a plurality of apertures 92 therein as well as a centrally located, depending valve stem 94. It will be evident from FIGS. 7 and 10 that the valve stem 94 is sized so that it will enter the opening 66 on the top of the container to shut off the flow of fluid from the container into the tube 72.

The frustro-conical portion 74 of the support tube 72 is provided with a peripheral groove 96 and this groove receives an annular flange 98 on the valve means 88 whereby the valve can be snapped into place in the lower end of the tube and, due to the pliability of its plastic structure, the valve means 88 can be easily removed for purposes of cleaning or replacement.

Figure 10:
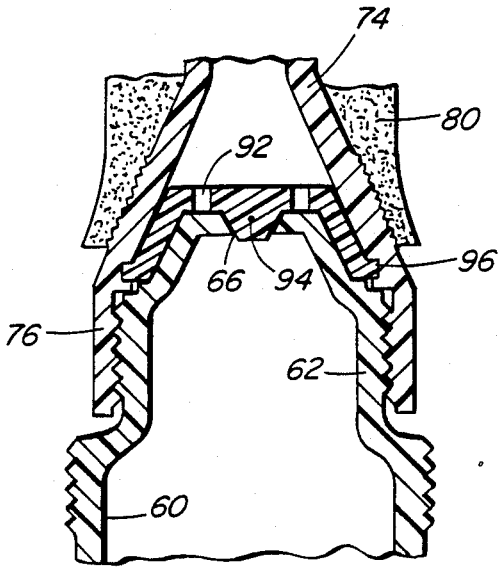
FIG. 10 is a fragmentary view similar to FIG. 7, but showing the valve in a closed position.

FIG. 7 shows the valve means 88 in an open position which is obtained by the user rotating the base 76 of the tube 74 and, due to its threaded connection with the upper end of the container 60, raises the valve 88 from the seating and sealing position with the central aperture 66 in the container and, when pressure is applied to the container, liquid will then flow through the aperture 66 in the upper end thereof, through the apertures 92 in the valve body and into the interior of the support tube 72 and then out through the openings 82 into the sponge 80. FIG. 10 shows the position of the various elements when the tube base 76 is rotated to place the valve 88 in a closing position relative to the aperture 66. It will be understood that, depending on the viscosity of the liquid in the container 60, the valve can be opened to provide as little or as much flow as required.

It will be appreciated that other configurations of sleeves and containers can be used in addition to those illustrated. For example, a sponge sleeve of triangular cross-section providing three broad, flat surfaces for the application of liquid could be utilized. Therefore, while the invention has been described in connection with specific embodiments and in a specific use, various modifications of the invention will occur to those skilled in the art without departing from the spirit and scope of the invention as set forth in the appended claims.

The terms and expressions which have been employed in this specification are used as terms of description and not of limitations and there is no intention in the use of such terms and expressions to exclude any equivalents of the features shown and described or portions thereof.

The embodiments of the invention in which an exclusive property or privilege is claimed are defined as follows.

1. An applicator for applying liquid to a person's body, comprising:

a storage container for the liquid to be applied, said storage container having an aperture defined in an upper end thereof and a neck portion with a threaded outer surface;

an elongated, fluid transmission tube including walls extending axially upwardly from said upper end of said container said tube having a lower end with a threaded inner periphery for engaging the threaded outer surface of the neck portion of said storage container and a plurality of apertures defined in the walls thereof for passage there through of liquid from the interior of said tube;

sponge means for receiving liquid from said tube and including a liquid permeable sleeve coaxially mounted on and supported by said elongated tube, said sponge means enveloping substantially the full length of said tube; and valve means for controlling flow of liquid from said container to said tube and including a disc detachably coupled to the lower end of said tube and having a plurality of openings defined therein and a stem portion depending from said disc for cooperation with said aperture in the upper end of said storage container so that rotation of the lower end of said tube on its threaded connection with said container neck, raises or lowers said stem portion into or out of engagement with said aperture and wherein said lower end of said tube further includes a frusto-conical section intermediate the threaded portion thereof and the portion supporting said sponge means and a peripheral channel formed in said frusto-conical section and wherein said disc further includes a frusto-conical wall portion in surface contact with said frusto-conical section of said tube and a peripheral rim snap-fitted into said channel whereby said valve means is quickly detachable for cleaning.

2. Apparatus according to claim 1, wherein said container has a removable bottom.

3. An applicator according to claim 1 wherein said apertures defined in said tube walls are angularly disposed with respect to the longitudinal axis of said tube so as to direct said liquid into specific areas of said sponge means, said apertures being graduated in size along the length of said tube.

4. An applicator according to claim 1 wherein said elongated, fluid transmission tube includes a closed upper end.

5. An applicator as in claim 1 wherein the cross-sectional shape of said tube is circular.

6. An applicator as in claim 1 wherein the cross-sectional shape of said tube is triangular.

7. An applicator as in claim 1 wherein the diameter of said apertures defined in the tube walls have a common size.

8. An applicator as in claim 1 wherein said apertures defined in the tube walls have diameters that are graduated in size beginning with smaller diameters adjacent said lower end.

* * * * *